US009129451B2

(12) United States Patent
Frueh

(10) Patent No.: US 9,129,451 B2
(45) Date of Patent: Sep. 8, 2015

(54) ACCESS CONTROL DEVICE

(75) Inventor: Bernhard Frueh, Oberachern (DE)

(73) Assignee: Kaba Gallenschuetz GmbH, Buehl (DE)

( * ) Notice: Subject to any disclaimer, the term of this patent is extended or adjusted under 35 U.S.C. 154(b) by 323 days.

(21) Appl. No.: 13/583,992

(22) PCT Filed: Mar. 22, 2011

(86) PCT No.: PCT/DE2011/075045

§ 371 (c)(1),
(2), (4) Date: Sep. 11, 2012

(87) PCT Pub. No.: WO2011/116764

PCT Pub. Date: Sep. 29, 2011

(65) Prior Publication Data

US 2013/0002399 A1 Jan. 3, 2013

(30) Foreign Application Priority Data

Mar. 23, 2010 (DE) ..... 10 2010 016 098

(51) Int. Cl.
*G07C 9/00* (2006.01)

(52) U.S. Cl.
CPC ..... *G07C 9/00087* (2013.01)

(58) Field of Classification Search
USPC ..... 340/5.52, 5.82, 5.83; 235/380, 382, 235/384; 382/115; 705/13
See application file for complete search history.

(56) References Cited

U.S. PATENT DOCUMENTS 6,170,744 B1 * 1/2001 Lee et al. ..... 235/380
6,695,203 B2 * 2/2004 Iki et al. ..... 235/375
7,669,760 B1 * 3/2010 Zettner ..... 235/382
8,174,356 B2 * 5/2012 Ponert et al. ..... 340/5.61
8,665,062 B2 * 3/2014 Bragagnini et al. ..... 340/5.52
2002/0153409 A1 * 10/2002 Yu ..... 235/375
2002/0169977 A1 * 11/2002 Chmaytelli ..... 713/200
2003/0055689 A1 * 3/2003 Block et al. ..... 705/5

(Continued)

FOREIGN PATENT DOCUMENTS

DE 10 2004 048 403 4/2006
EP 1 760 668 3/2007

(Continued)

OTHER PUBLICATIONS

International Search Report of PCT/DE2011/075045, Sep. 20, 2011.

(Continued)

*Primary Examiner* — Brian Zimmerman
*Assistant Examiner* — An T Nguyen
(74) *Attorney, Agent, or Firm* — Collard & Roe, P.C.

(57) ABSTRACT

From the prior art, access control devices are already known in which a distinction is made between a first detection device (2) and the actual access and access is enabled or not, on the basis of a comparison of the data detected by the first detection device (2) with the data detected again at the actual access lock (7). Starting from the prior art, the solution according to the invention proposes an expansion of the system such that modern Internet booking procedures are considered and furthermore the new possibilities of facial recognition are performed in a quasi manner as the last examination before access is enabled, and access is granted or rejected depending on the examination result, in other words the examination of a biometric feature. The invention can be used for a border crossing control device.

9 Claims, 1 Drawing Sheet

(56) References Cited

U.S. PATENT DOCUMENTS

| | | | | |
|---|---|---|---|---|
| 2003/0111530 | A1* | 6/2003 | Iki et al. | 235/382 |
| 2003/0150922 | A1* | 8/2003 | Hawes | 235/494 |
| 2003/0198082 | A1* | 10/2003 | Silverbrook et al. | 365/185.04 |
| 2004/0169076 | A1 | 9/2004 | Beale et al. | |
| 2004/0190757 | A1* | 9/2004 | Murphy et al. | 382/115 |
| 2005/0146417 | A1* | 7/2005 | Sweatte | 340/5.2 |
| 2006/0055512 | A1* | 3/2006 | Chew | 340/5.82 |
| 2006/0157559 | A1* | 7/2006 | Levy et al. | 235/380 |
| 2007/0046426 | A1* | 3/2007 | Ishibashi | 340/5.52 |
| 2007/0206839 | A1* | 9/2007 | Hanna et al. | 382/115 |
| 2008/0013796 | A1* | 1/2008 | Bonalle et al. | 382/115 |
| 2008/0302870 | A1* | 12/2008 | Berini et al. | 235/380 |
| 2009/0008439 | A1* | 1/2009 | Kubler et al. | 235/375 |
| 2010/0078475 | A1* | 4/2010 | Lin et al. | 235/380 |
| 2010/0186083 | A1* | 7/2010 | Shinzaki et al. | 726/19 |
| 2013/0002399 | A1* | 1/2013 | Frueh | 340/5.53 |

FOREIGN PATENT DOCUMENTS

| | | |
|---|---|---|
| GB | 2 418 511 | 3/2006 |
| WO | WO 03/065145 | 8/2003 |
| WO | WO 2005/027023 | 3/2005 |
| WO | WO 2008/055181 | 5/2008 |

OTHER PUBLICATIONS

"Checksum", Wikipedia article, downloaded from http://en.wikipedia.org/wiki/Checksum on Feb. 20, 2015.

* cited by examiner

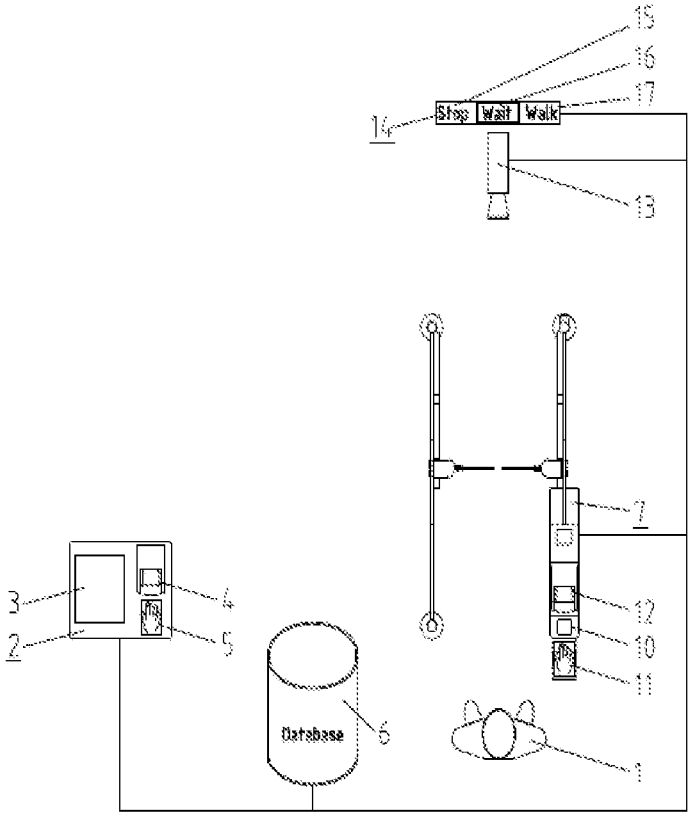
15
16
17
14
Stop
Wait
Walk
13
7
3
4
2
5
12
10
11
Database
6
1

ACCESS CONTROL DEVICE

CROSS REFERENCE TO RELATED APPLICATIONS

This application is the National Stage of PCT/DE2011/075045 filed on Mar. 22, 2011, which claims priority under 35 U.S.C. §119 of German Application No. 10 2010 016 098.9 filed on Mar. 23, 2010, the disclosure of which is incorporated by reference. The international application under PCT article 21(2) was not published in English.

The present invention relates to an access control device, particularly a border crossing control device, having a person passage gate that releases access or blocks it, whereby this person passage gate has at least one document reading unit and at least one biometric recording device assigned to it, which are connected with a control unit of the person passage gate, which unit in turn is connected with a central database, and access can be released or blocked as a function of a comparison of the data recorded with the recording device of the person passage gate with the data stored in the central database.

Such an access control device is known from DE 10 2004 048 403 A1. Such access control devices are required, above all due to increased security demands, particularly in the airport sector, in order to be able to perform the increased security demands and the correspondingly more complicated checks with as little personnel effort as possible, at a simultaneously greater security standard. In this connection, it is considered to be particularly problematic that one person might take another person's place between the actual booking procedure, for example the check-in, and the actual boarding procedure at the airport. Particularly with regard to this aspect, simply checking a flight ticket is by no means sufficient any longer. Of course, the same problem affects all security-relevant regions in which a change in location between issuance of a legitimizing document or some other legitimation device and its inspection during access to the secured region is unavoidable. The same problem therefore occurs also within extensive corporate facilities, exhibition areas, or bank areas.

Proceeding from this state of the art, an access control device having a further increased security standard and further increased operation convenience is supposed to be created.

A solution for this task is made possible with an access control device according to the invention. Advantageous embodiments of the invention are discussed below.

Because, according to the invention, an individual, temporary flight record is stored for every flight procedure, which record is already created at the time of booking, a comparison of the ID presented by the user for legitimation can also be undertaken in the region of a first recording device, which lies ahead of the person passage gate that actually releases and blocks access, and thus the corresponding flight record can be called up in the database, and at least one person-identifying document can be read in, and a biometric datum, such as a fingerprint or a facial image, can be recorded by means of further recording devices assigned to the recording device, and can be entered into the individual flight record in the central database.

Already at this point, accordingly, a connection of the flight data generated by way of a conventional booking procedure with an ID that clearly identifies the procedure, a personal document, and a biometric datum is produced.

In a concrete embodiment, the ID that identifies the flight procedure can be generated in the form of a preferably two-dimensional barcode, which is then handed over to the user either in the form of a printout or also in the form of a file that can be displayed on a display. With this ID, the user can then document his identity in the region of the first recording device, and the flight record stored in the central database can be expanded to include further data that clearly identify the user, for example the personal document data and one or more biometric data.

To further increase the security standard, a first check takes place, already in the region of the first recording device, as to whether the data recorded or entered with the booking procedure correlate with those of the person-identifying document, whereby for this purpose, a usual checksum comparison is carried out, in other words a minimum number or also the completeness of the available data are compared, and it is determined whether the sum of the agreements found satisfies a minimum standard. Only if the required checksum is reached does the booking procedure continue. Otherwise, the insufficiently validated flight record is blocked, so that no access to the secured area can be achieved by way of this flight record, at least not without further inspection or manual intervention.

The checksum check has the advantage that it can also be used with a so-called fuzzy logic, in other words a logic that can compare imprecise data, such as those that occur in connection with image recognition. Furthermore, the fuzzy logic with checksum comparison can still yield a positive result if a minimum degree of agreements is achieved. In this manner, simple typographical errors during the booking procedure or simple reading errors of text recognition do not already lead to stopping of the further booking procedure. In the interests of handling large numbers of persons, the security standard can be flexibly increased or lowered with such flexible methods.

In the event that within the scope of the check described, the further checking process is not blocked, in other words is continued, a further biometric datum is added to the flight record, in that the facial image contained in the person-identifying document, for example, or another biometric datum is read in, and stored in the flight record stored in the temporary, central file, or an additional biometric characteristic is recorded and stored, such as a new facial image, for example, or the imprint of one or more fingerprints.

The person passage gate that follows the recording device advantageously has an optical and/or acoustical signal unit assigned to it, with which the user of the person passage gate is first requested to present identification. This can be, for example, the boarding card with the imprinted ID, in other words, for example, a two-dimensional barcode, which is recorded with the barcode scanner assigned to the person passage gate.

Furthermore, the person passage gate has a document reader and/or a biometric recording unit for recording of at least one further identifying characteristic. The user is requested, by means of the signal device, after having presented the boarding card, or by means of another identifying unit, on the basis of which identification of the corresponding flight record is possible, either to place a fingerprint on a corresponding recording device or to present a person-identifying document to the document reader. By means of this additionally recorded characteristic, authentication is then performed, once again, in that a checksum having the aforementioned advantages is formed.

In the event that sufficient matching with the data in the selected flight record has taken place, in other words that corresponding allocation is possible, the access control procedure can then be continued as follows: By means of a further optical recording device assigned to the person passage gate, such as a CCD element, a current facial image of the user is generated and compared with the facial data stored in the flight record, by way of facial recognition software. As soon as the facial recognition was successful, the person passage gate releases access.

The two-step procedure, in this regard, of authentication of the user and further checking, is advantageously accompanied by a traffic-light system assigned to the signal unit. For example, the traffic light shows the red signal light when the user approaches, which means that access is blocked. If the required checksum for authentication for selection of the flight record assigned to the flight procedure is achieved after the request for submission of a biometric characteristic, in other words a fingerprint, for example, or for presentation of a person-identifying document, the traffic light system changes to orange, for example. The user is then requested to look into the optical recording device for generation of a facial image, whereby this is then passed to the facial recognition that has already been described. If this takes place successfully, as well, the traffic light system changes to green, with the meaning that it is now possible to pass through the access.

For reasons of data security, but also in the interests of keeping the temporary database small, the flight records stored for handling of the booking procedure are automatically deleted after the person passes through the person passage gate, at the earliest, but after expiration of a defined time interval, at the latest.

In an advantageous further development, the central database containing the temporary flight records can be compared with a so-called blacklist, in which the personal characteristics of undesirables (persona non grata), other persons blocked from access, or at least of persons for whom no fully automatic checking is desired, are stored. At the latest before release of access, a comparison of the data stored in the flight record with the blacklist takes place. Here, too, if a critical checksum is exceeded, access is not released or the further booking procedure is discontinued, so that then further checking, for example a personal inspection, is possible. In contrast to the temporary flight records, the blacklist is permanently stored in the central database.

In an advantageous embodiment, a document checking unit is additionally assigned to either the first recording device or the person passage gate, with which unit further checking characteristics, for example watermarks or chips or the like disposed in the personal document, can be checked, in order to recognize forged person-identifying documents, for example. If the check with the document checking unit shows that a forged document was presented, further processing of the booking or boarding procedure, but at least release of access, is blocked.

The invention will be explained in greater detail below, using an exemplary embodiment that is shown only schematically in the drawing.

The drawing shows

FIG. 1 a fundamental diagram of the arrangement of an access control device, as it could be implemented within the scope of the invention, as an example.

The starting point is that the user 1, even before he approaches the first recording device 2, has initiated a booking either at a travel agency or on the Internet, on the basis of which booking a temporary flight record assigned to the user 1, in each instance, and to the booking procedure, in each instance, was stored in a central database 6. Each flight record is uniquely identified with a barcode. This barcode, which is two-dimensional in the present example, has been transmitted to the user 1 as a file, which he now carries with him on a display, in other words in a portable computer or a cell phone, for example, or has with him as a printout.

The first recording device 2 comprises not only a display unit 3 but also a barcode scanner 4. Instead of the barcode scanner 4, a document reader can also be provided, with which not only the 2-D barcode of a boarding card or a ticket printed out at home but also the chip of a person-identifying document, in other words a passport, for example, can be read out with regard to the biometric image or the RFID data. The same document reader could then also read and recognize the machine-readable data of the person-identifying document.

At the first recording device 2, the user 1 is first requested to identify himself by means of the barcode, whereby then, the flight record stored in the central database 6 is called up by the first recording device 2.

Subsequently, the user 1 is requested to offer one or four fingerprints for recording by a first fingerprint reader 5. Supplementally, the user 1 is requested to present a person-identifying document. The person-identifying document, just like the fingerprint or fingerprints, is read in, and the corresponding data are temporarily entered into the flight record in the central database 6.

After these additional procedures have been completed, the first recording device 2 shows the user 1 a signal that allows further passing for him, in other words that his check-in procedure in the airport entry region has now been completed, and that he can go to the gate where boarding is to take place at a fixed time.

In the boarding region, a person passage gate 7 is then disposed, whereby the user 1 is requested, by way of a corresponding signal unit 10 in the region of the person passage gate 7, to now identify himself either by way of the person-identifying document or a fingerprint. For this reason, both a second fingerprint reader 11 and a document reading unit 12 are assigned to the person passage gate 7. By means of the data recorded in this regard, the related flight record in the central database 6 is then called up by means of a checksum comparison.

Subsequently, the user 1 is asked to look into a camera 13 in order to produce a facial image. The image produced at the time of boarding is now compared with the image already stored in the central database 6, which can be derived either from image recording in the region of the first recording device 2 or from the person-identifying document, in the sense of facial recognition. In the event that the image recognition automatically recognizes the user 1, whereby once again, a checksum is formed, the user 1 can pass through the person passage gate 7.

In this connection, the procedure is made visible to the user 1 by means of a traffic light system, in that a red STOP signal 15 is first shown to the user 1, as well as a yellow WAIT signal 16 if access to the flight record was possible by way of the data offered by him, in other words by way of the fingerprint or the person-identifying document. As soon as the facial recognition has also clearly identified the user 1, the possibility of now passing through the person passage gate 7 is displayed to the user 1 with the green WALK signal 17.

Not shown further here, but included within the scope of the invention, is a further comparison of the flight records stored in the temporary database with blacklist data permanently stored in the central database 6. In the event that a comparison of the data stored in the temporary flight records with personal data stored in the blacklist exceeds a critical checksum, the corresponding flight record is blocked, so that passing through the person passage gate 7 is not possible with this flight record or for this passenger.

In all other cases, as well, in which checking of the data does not achieve the required level of agreement, the corresponding flight record is blocked. This does not necessarily mean that it will not be possible to pass through the person passage gate 7 with this flight record, after all. In most cases, however, it will be necessary for personal inspection of the data to take place, so that then a legitimized person can release the access by hand. In this way, possible incorrect recognitions, for example, can be corrected by hand. However, the corresponding possibility of error correction should be the exception. Otherwise, the above system describes an advantageous possibility of fully automatic check-in and boarding processing, which can be carried out, to the greatest possible extent, without the use of personnel, at a high security standard.

In addition, a document checking unit, which is not shown in any detail here, can be disposed in the region of the first recording device 2 or also of the person passage gate 7, with which unit the presented person-identifying documents can additionally be checked to ensure that no forgery is presented, in that additional checking characteristics such as integrated chips or watermarks are checked.

Above, an access control device has therefore been described, which simultaneously implements a security standard that has not been achieved until now, and reduces the personnel effort to a minimum.

REFERENCE SYMBOL LIST

1 user
2 first recording device
3 display unit
4 barcode scanner
5 first fingerprint reader
6 central database
7 person passage gate
10 signal unit
11 second fingerprint reader
12 document reading unit
13 camera
14 traffic light system
15 STOP signal
16 WAIT signal
17 WALK signal

The invention claimed is:

1. Access control device, having a person passage gate that releases or blocks access to an aircraft, wherein this person passage gate has at least one document reading unit and at least one optical recording device assigned to it, wherein the at least one document reading unit of the person passage gate and the at least one optical recording device of the person passage gate are connected with a control unit of the person passage gate, wherein the control unit in turn is connected with a central database, and releases or blocks the person passage gate as a function of a comparison of the data recorded with at least one of the at least one document reading unit of the person passage gate and the at least one optical recording device of the person passage gate with data stored in the central database, wherein an individual, temporary flight record is stored in the central database for every passenger and every flight, wherein the individual, temporary flight record was compiled at the time of booking of the flight, in each instance, wherein the individual temporary flight record at first comprises at least the booking data of the flight and an ID of the flight record, wherein a first recording device precedes the person passage gate, comprises a check-in biometric recording device and a check-in barcode scanner, scans via the check-in barcode scanner a boarding unit comprising a barcode and presented by a person, the barcode having been generated at the booking of the flight and comprising the ID of the flight record, the boarding unit comprising a ticket, a laptop display, or a cell phone display, to gather person identifying document information, scans a person identifying document presented by the person, the person identifying document comprising a passport or a personal identity card, transmits the ID of the flight record to the central database to call up the individual, temporary flight record and transmits the person identifying document information from the person identifying document to the central database for comparison with the individual, temporary flight record, after the comparison of the individual, temporary flight record with the person identifying document information, records, via the check-in biometric reading device, check-in biometric information of the person, and enters the check-in biometric information into the individual temporary flight record, the check-in biometric information comprising a facial image of the person and at least one further biometric characteristic of the person, wherein the control unit only releases the person passage gate if first, via the at least one document reading unit of the person passage gate, person-identifying data of the person was recorded in the region of the person passage gate via the at least one document reading unit of the person passage unit, and a current facial image of the person was generated via the at least one optical recording device of the person passage gate, and was successfully compared with the facial image of the check-in biometric information stored in the temporary flight record, wherein the person passage gate comprises a computer having an evaluation unit, the computer being connected to the at least one document reading unit of the person passage unit, the evaluation unit being able to read out the person-identifying data recorded by the at least one document reading unit of the person passage unit, and wherein a comparison of the person-identifying data with data stored in the individual, temporary flight record that was called up-takes place, with formation of a checksum, and the boarding procedure can only be continued if a defined minimum sum is exceeded.

2. Access control device according to claim 1, wherein the at least one further biometric characteristic comprises one or more fingerprints of the person.

3. Access control device according to claim 1, wherein the person passage gate has an optical and/or acoustic signal unit assigned to it, in such a manner that users of the person passage gate can be requested, by way of the optical and/or acoustic signal unit, to present a document or a facial image to the at least one document reading unit of the person passage gate or to the at least one optical recording device of the person passage gate, for the purpose of identification.

4. Access control device according to claim 3, wherein facial recognition can be carried out via a software tool contained in the control unit of the person passage gate, on the basis of the facial image stored in the corresponding flight record, which facial image has already been identified via the checksum, and wherein access can be released if successful facial recognition occurs.

5. Access control device according to claim 3, wherein the optical and/or acoustical signal unit assigned to the person passage gate is provided with a traffic light system, and wherein the traffic light system switches from one traffic light signal to the next upon recognition of the flight record assigned to the person, and after subsequent successful facial recognition, changes to the next following traffic light signal to signal successful release of the pass-through.

6. Access control device according to claim 1, wherein the flight record can be automatically deleted after release of the person passage gate, at the earliest, but after expiration of a defined time interval, at the latest.

7. Access control device according to claim 1, wherein the data of the individual, temporary flight record stored in the central database are compared, at the latest before release of access by the person passage gate, with the data stored in a so-called blacklist, and if a critical checksum is exceeded, release of access by the person passage gate is blocked.

8. Access control device according to claim 1, wherein a document checking unit for checking the authenticity of the person-identifying documents presented is additionally assigned to the first recording device and/or the person passage gate.

9. Access control device according to claim 1, wherein the person passage gate further comprises a fingerprint reader, and wherein the at least one further biometric characteristic of the person comprises one or more fingerprints of the person.

* * * * *